US010076927B2

(12) United States Patent
Pasinski

(10) Patent No.: US 10,076,927 B2
(45) Date of Patent: Sep. 18, 2018

(54) MOVEABLE PAINT TRAY

(71) Applicant: Tom Pasinski, Chicago, IL (US)

(72) Inventor: Tom Pasinski, Chicago, IL (US)

( * ) Notice: Subject to any disclaimer, the term of this patent is extended or adjusted under 35 U.S.C. 154(b) by 388 days.

(21) Appl. No.: 14/810,512

(22) Filed: Jul. 28, 2015

(65) Prior Publication Data

US 2016/0031257 A1 Feb. 4, 2016

Related U.S. Application Data

(60) Provisional application No. 62/032,654, filed on Aug. 4, 2014.

(51) Int. Cl.
*B44D 3/12* (2006.01)
*B05C 17/02* (2006.01)

(52) U.S. Cl.
CPC ..... *B44D 3/126* (2013.01); *B05C 17/0245* (2013.01)

(58) Field of Classification Search
CPC ..... B44D 3/126; B44D 3/121; B44D 3/12; B05C 17/0245
See application file for complete search history.

(56) References Cited

U.S. PATENT DOCUMENTS

| | | | | |
|---|---|---|---|---|
| 4,509,226 | A * | 4/1985 | Allison | B44D 3/126 15/257.06 |
| 5,984,129 | A | 11/1999 | Pasinski | |
| 8,733,577 | B2 * | 5/2014 | Patterson | A45F 3/46 206/192 |
| 9,168,781 | B1 * | 10/2015 | Cooper | B44D 3/126 |
| 2014/0096338 | A1 * | 4/2014 | Enguita | B44D 3/126 15/257.06 |

* cited by examiner

*Primary Examiner* — Shay Karls
(74) *Attorney, Agent, or Firm* — Donald J. Ersler

(57) ABSTRACT

The moveable paint tray preferably includes a base ring, a peripheral wall, a sloped ramp, an engagement platform, a handle and a hood. The peripheral wall extends upward from an outer perimeter of the base ring. A liquid support surface is formed in a portion of an inner perimeter of the base ring. The sloped ramp extends upward from an end of the liquid support surface. The engagement platform extends from an end of the sloped ramp. A ramp wall extends inward and upward from an inner perimeter of the base ring to the sloped ramp and the engagement platform. The handle extends from an outer perimeter of the peripheral wall, adjacent the engagement platform. A drain spout is formed through the peripheral wall on an end opposite the handle. A second embodiment of the moveable paint tray does not include a hood for nesting multiple units together.

19 Claims, 4 Drawing Sheets

MOVEABLE PAINT TRAY

CROSS-REFERENCES TO RELATED APPLICATIONS

This is a utility patent application taking priority from provisional application No. 62/032,654 filed on Aug. 4, 2014.

BACKGROUND OF THE INVENTION

1. Field of the Invention

The present invention relates generally to paint trays and more specifically to a moveable paint tray, which retains liquid for application to a paint roller in a one-piece plastic structure.

2. Discussion of the Prior Art

U.S. Pat. No. 5,984,129 to Paskinski discloses a movable paint tray assembly for applying a liquid to a roller. However, Paskinski does not teach or suggest a paint tray fabricated from a single piece of molded material.

Accordingly, there is a clearly felt need in the art for a moveable paint tray, which may be used to retain liquid for application to a paint roller in a one-piece plastic molded structure.

SUMMARY OF THE INVENTION

The present invention provides a moveable paint tray, which retains liquid for application to a paint roller in a one-piece molded structure. The moveable paint tray preferably includes a base ring, a peripheral wall, a sloped ramp, an engagement platform, a handle and a hood. The moveable paint tray is created with a plastic blow molding process. The peripheral wall extends upward from an outer perimeter of the base ring. The peripheral wall preferably includes an outwardly sloping cross section. A liquid fill line is formed in a portion of the peripheral wall. A liquid support surface is formed in a portion of an inner perimeter of the base ring. The sloped ramp extends upward from an end of the liquid support surface. The engagement platform extends from an end of the sloped ramp. A top of the engagement platform is disposed below a top edge of the peripheral wall. A paint roller cavity is formed in the engagement platform to receive an end of a paint roller.

A ramp wall extends inward and upward from the inner perimeter of the base ring. The ramp wall extends upward to each end of the sloped ramp and an outer perimeter of the engagement platform. A liquid trough is formed between the peripheral wall and the ramp wall and communicates with the liquid support surface. The handle extends from an outer perimeter of the peripheral wall, adjacent the engagement platform. A drain spout is formed through the peripheral wall on an end opposite the handle. The drain spout is preferably sealed with a removable cap. The hood covers a portion of the liquid support surface. The hood extends from a portion of a top edge of the peripheral wall.

A second embodiment of the moveable paint tray does not include a hood. The second embodiment of the moveable paint tray is created with plastic injection molding. In use, a liquid, such as paint is poured over the liquid support surface, until the liquid fill line is reached. The paint will flow into and around the liquid trough. Paint is drained from the removal tray by removing the removable cap and pouring the paint into a container. The moveable paint tray may be transported in a vertical orientation, while retaining a volume of paint.

Accordingly, it is an object of the present invention to provide a moveable paint tray, which may be used to retain liquid for application to a paint roller in a one-piece molded structure.

These and additional objects, advantages, features and benefits of the present invention will become apparent from the following specification.

DETAILED DESCRIPTION OF THE PREFERRED EMBODIMENTS

Figure 1:
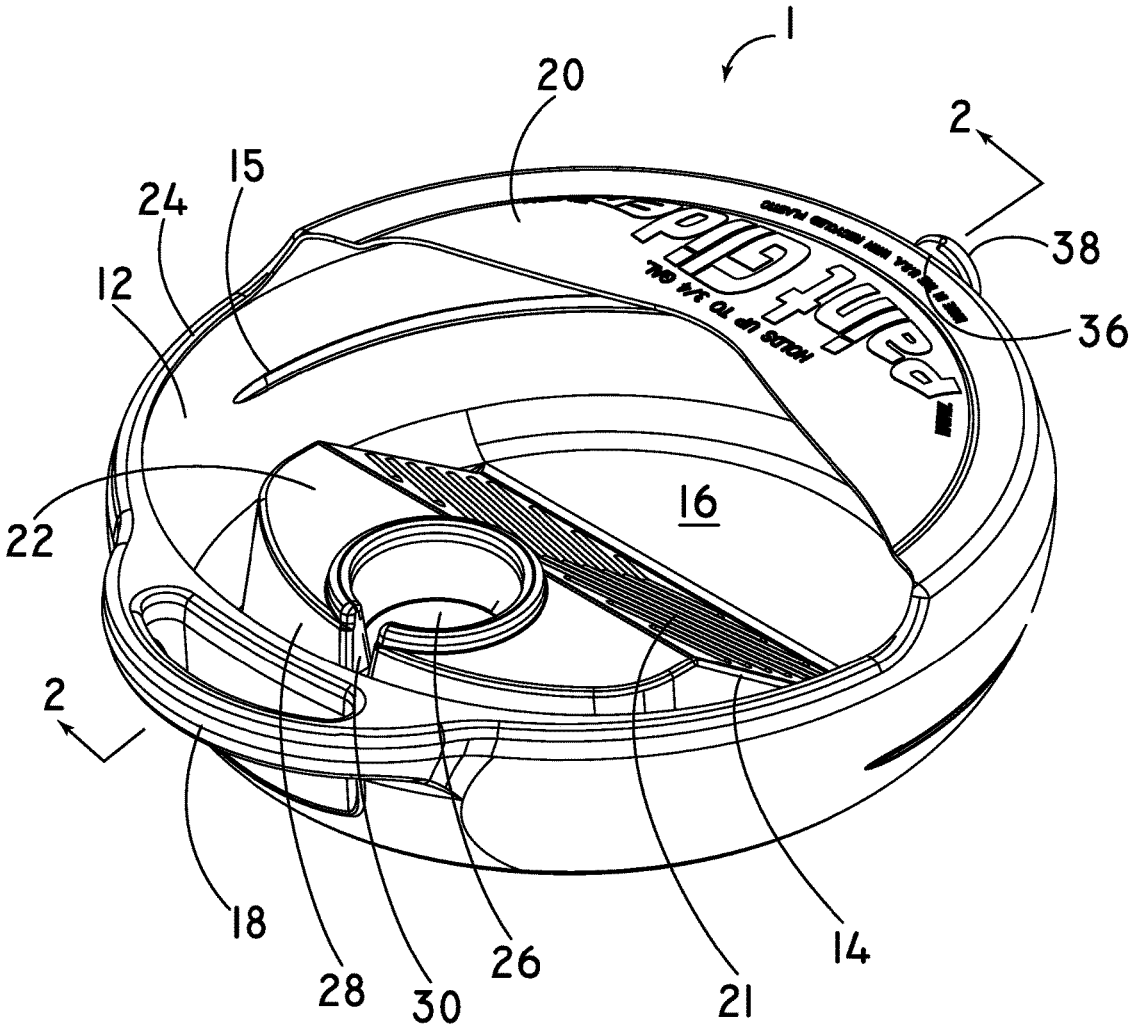
FIG. 1 is a top perspective view of a moveable paint tray in accordance with the present invention.
Figure 2:
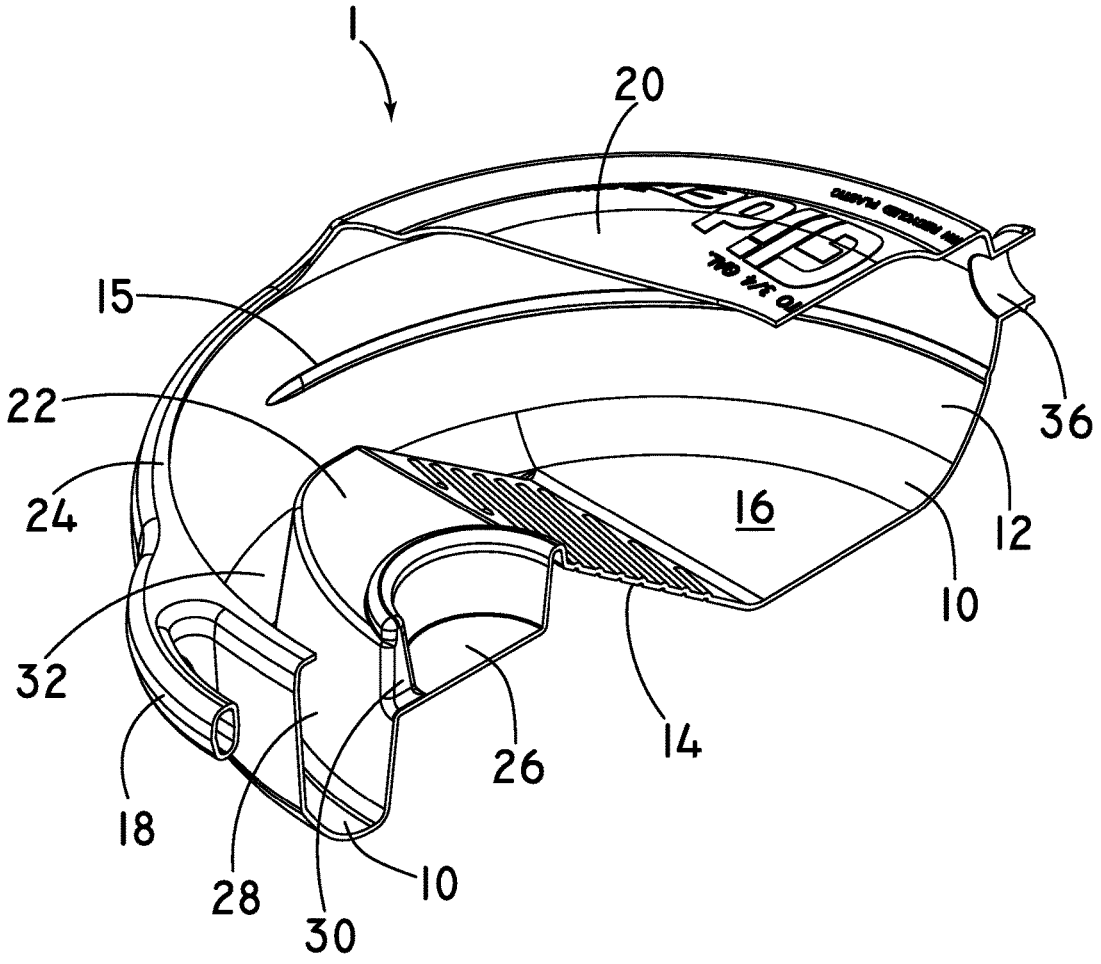
FIG. 2 is a cross sectional perspective view of a moveable paint tray cut through FIG. 1 in accordance with the present invention.
Figure 3:
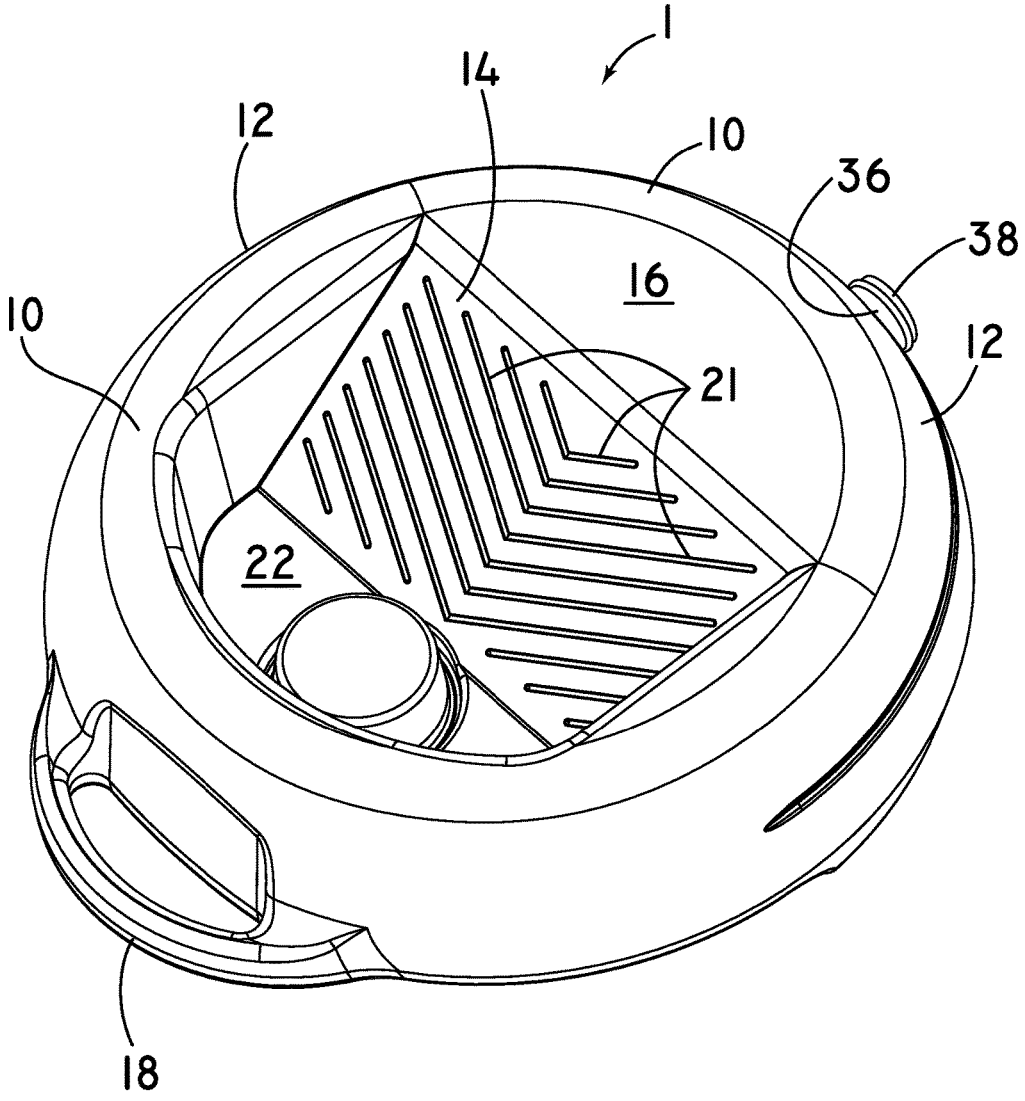
FIG. 3 is a bottom perspective view of a moveable paint tray in accordance with the present invention.

With reference now to the drawings, and particularly to FIG. 1, there is shown a top perspective view of a moveable paint tray 1. With reference to FIGS. 2-3, the moveable paint tray 1 preferably includes a base ring 10, a peripheral wall 12, a sloped ramp 14, an engagement platform 16, a handle 18 and a hood 20. The moveable paint tray 1 is created with a plastic blow molding process. The base ring 10 preferably includes a curved cross section. Only a small portion of the base ring 10 actually contacts a support surface. The small contact portion allows the moveable paint tray 1 to be pulled across drop cloth or rotated on the drop cloth. The peripheral wall 12 extends upward from an outer perimeter of the base ring 10. The peripheral wall 12 preferably includes an outwardly sloping cross section. A liquid fill line 15 is formed in a portion of the peripheral wall 12.

The liquid support surface 16 extends from a portion of an inner perimeter of the base ring 10. The sloped ramp 14 extends upward from an end of the liquid support surface 16. A plurality of projections 21 are formed in the sloped ramp 14 to extract excess paint from a paint roller (not shown). The engagement platform 22 extends from an end of the sloped ramp 14 in a substantially horizontal plane. A top of the engagement platform 18 is disposed below a top edge 24 of the peripheral wall 12. A paint roller cavity 26 is formed in the engagement platform 22 to receive an end of a paint roller (not shown).

A ramp wall 28 extends inward and upward from the inner perimeter of the base ring 10. The ramp wall 28 extends upward to each end of the sloped ramp 14 and an outer perimeter of the engagement platform 22. A drain slot 30 is formed through the ramp wall 28 to provide drainage for the paint roller cavity 26. A liquid trough 32 is formed between the peripheral wall 12 and the ramp wall 28 and communicates with the liquid support surface 16. The handle 18 extends from an outer perimeter of the peripheral wall 12, adjacent the engagement platform 20. A drain spout 36 is formed through the peripheral wall 12 on an end opposite the handle 18. The drain spout 36 is preferably sealed with a removable cap 38. The hood 20 covers a portion of the liquid support surface 16. The hood 20 extends from a portion of the top edge 24 of the peripheral wall 12.

In use, a liquid, such as paint is poured over the liquid support surface 16, until the liquid fill line 15 is reached. The paint will flow into and around the liquid trough 32. Paint is drained from the moveable removal tray 1 by removing the removable cap 38 and pouring the paint into a paint container through the drain spout 36. The hood 20 allows the moveable paint tray 1 to be transported in a vertical orientation, while retaining a volume of paint.

Figure 4:
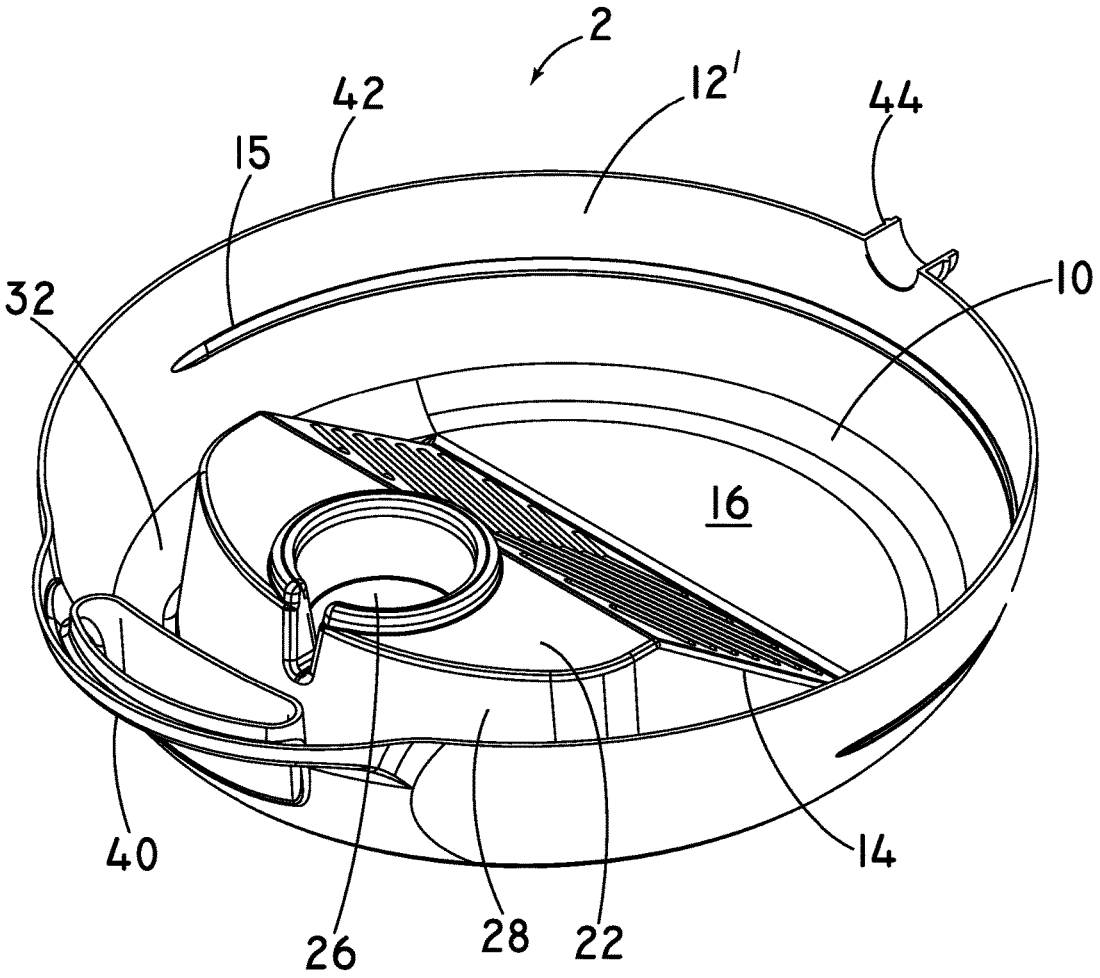
FIG. 4 is a top perspective view of a second embodiment of a moveable paint tray in accordance with the present invention.

With reference to FIG. 4, a moveable paint tray 2 is created with plastic injection molding. The moveable paint tray 2 preferably includes the base ring 10, a peripheral wall 12', the sloped ramp 14, the engagement platform 16 and a handle 40. The moveable paint tray 2 is created with a plastic injection process. The lack of hood 20 allows the moveable paint tray 2 to be nested together for efficient shipping. The peripheral wall 12' extends upward from an outer perimeter of the base ring 10. The liquid fill line 15 is formed in a portion of the peripheral wall 12'. The liquid support surface 16 extends from a portion of an inner perimeter of the base ring 10. The sloped ramp 14 extends upward from an end of the liquid support surface 16. The plurality of projections 21 are formed in the sloped ramp 14. The engagement platform 22 extends from an end of the sloped ramp 14. A top of the engagement platform 22 is disposed below a top edge 42 of the peripheral wall 12. The paint roller cavity 26 is formed in the engagement platform 22 to receive an end of a paint roller.

The ramp wall 28 extends inward and upward from the inner perimeter of the base ring 10. The ramp wall 28 extends upward to each end of the sloped ramp 14 and to the outer perimeter of the engagement platform 22. The drain slot 30 is formed through the ramp wall 28 to provide drainage for the paint roller cavity 26. The liquid trough 32 is formed between the peripheral wall 12 and the ramp wall 28. The handle 42 extends from an outer perimeter of the peripheral wall 12', adjacent the engagement platform 20. A drain spout boss 44 is formed in the peripheral wall 12 on an end opposite the handle 42. In use, a liquid, such as paint is poured over the liquid support surface 16, until the liquid fill line 15 is reached. The paint will flow into and around the liquid trough 32. Paint is drained from the moveable removal tray 2 by tilting thereof and pouring the paint into a paint container through the drain spout boss 44.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A moveable paint tray comprising:

a base ring having an inner perimeter and an outer perimeter;

a peripheral wall extending outward from an outer perimeter of said base ring;

a liquid support surface extends inward from a portion of said inner perimeter of said base ring;

a sloped ramp extends upward from an end of said liquid support surface;

an engagement platform extends from an end of said sloped ramp, a top of said engagement platform is located below a top edge of said peripheral wall;

a ramp wall extends upward from said inner perimeter of said base ring to said sloped ramp and said engagement platform, wherein a liquid is poured on to said liquid support surface, a roller is placed into the liquid; and a drain opening is formed through said peripheral wall, said drain opening is located near a top of said peripheral wall.

2. The moveable paint tray of claim 1, further comprising:

a handle extends from an outer surface of said peripheral wall, said handle is located adjacent said engagement platform.

3. The moveable paint tray of claim 2 wherein:

said drain opening is formed through said peripheral wall on an end opposite of said handle.

4. The moveable paint tray of claim 1 wherein:

a paint roller cavity is formed in said engagement platform to receive an end of a paint roller, a drain slot is formed through said ramp wall to provide drainage for said paint roller cavity.

5. The moveable paint tray of claim 1 wherein:

said moveable paint tray is created by a plastic blow molding process.

6. The moveable paint tray of claim 1 wherein:

said moveable paint tray is created by a plastic injection process.

7. The moveable paint tray of claim 1 wherein:

a hood extends upward from said top edge of said peripheral wall, said drain opening is located adjacent said hood.

8. A moveable paint tray comprising:

a base ring having an inner perimeter and an outer perimeter;

a peripheral wall extending outward from an outer perimeter of said base ring;

a liquid support surface extends inward from a portion of said inner perimeter of said base ring;

a sloped ramp extends upward from an end of said liquid support surface;

an engagement platform extends from an end of said sloped ramp, a top of said engagement platform is located below a top edge of said peripheral wall;

a ramp wall extends upward from said inner perimeter of said base ring to said sloped ramp and said engagement platform, wherein a liquid is poured on to said liquid support surface, a roller is placed into the liquid; and a paint roller cavity is formed in said engagement platform to receive an end of a paint roller, a drain slot is formed through said ramp wall to provide drainage for said paint roller cavity, said paint roller cavity having a vertical axis.

9. The moveable paint tray of claim 8, further comprising:

a handle extends from an outer surface of said peripheral wall, said handle is located adjacent said engagement platform.

10. The moveable paint tray of claim 9 wherein:

a drain device is formed through said peripheral wall on an end opposite of said handle.

11. The moveable paint tray of claim 10 wherein:

a hood extends upward from said top edge of said peripheral wall, said drain device is located adjacent said hood.

12. The moveable paint tray of claim 8 wherein:

said moveable paint tray is created by a plastic blow molding process.

13. The moveable paint tray of claim 8 wherein:

said moveable paint tray is created by a plastic injection process.

14. A moveable paint tray comprising:

a base ring having an inner perimeter and an outer perimeter;

a peripheral wall extending outward from an outer perimeter of said base ring;

a liquid support surface extends inward from a portion of said inner perimeter of said base ring;

a sloped ramp extends upward from an end of said liquid support surface;

an engagement platform extends from an end of said sloped ramp; and a ramp wall extends upward from said inner perimeter of said base ring to said sloped ramp and said engagement platform, a liquid trough is created between said peripheral wall and ramp wall, said liquid trough communicates with said liquid support surface, said liquid trough is on the same level as said liquid support surface, said liquid trough and said liquid support surface surround said engagement platform.

15. The moveable paint tray of claim 14, further comprising:

a handle extends from an outer surface of said peripheral wall, said handle is located adjacent said engagement platform.

16. The moveable paint tray of claim 15 wherein:

a drain device is formed through said peripheral wall on an end opposite of said handle.

17. The moveable paint tray of claim 14 wherein:

a paint roller cavity is formed in said engagement platform to receive an end of a paint roller, a drain slot is formed through said ramp wall to provide drainage for said paint roller cavity.

18. The moveable paint tray of claim 14 wherein:

said moveable paint tray is created by a plastic blow molding process.

19. The moveable paint tray of claim 14 wherein:

said moveable paint tray is created by a plastic injection process.

* * * * *